US008288963B2

(12) United States Patent
Ryu et al.

(10) Patent No.: US 8,288,963 B2
(45) Date of Patent: Oct. 16, 2012

(54) LED DRIVING CIRCUIT HAVING ERROR DETECTION FUNCTION

(75) Inventors: Je Hyuk Ryu, Gyunggi-do (KR); Jung Eun Youm, Gyunggi-do (KR)

(73) Assignee: Samsung Electro-Mechanics Co., Ltd., Gyunggi-do (KR)

( * ) Notice: Subject to any disclaimer, the term of this patent is extended or adjusted under 35 U.S.C. 154(b) by 302 days.

(21) Appl. No.: 12/823,604

(22) Filed: Jun. 25, 2010

(65) Prior Publication Data

US 2011/0133673 A1 Jun. 9, 2011

(30) Foreign Application Priority Data

Dec. 9, 2009 (KR) ..... 10-2009-0121835

(51) Int. Cl.
*H05B 37/00* (2006.01)

(52) U.S. Cl. ..... 315/307; 315/224; 315/169.3

(58) Field of Classification Search ..... 315/169.3, 315/307, 308, 291, 224, 209 R
See application file for complete search history.

(56) References Cited

U.S. PATENT DOCUMENTS

2009/0140658 A1* 6/2009 Jo et al. ..... 315/155
2012/0074847 A1* 3/2012 Shimomura et al. ..... 315/125

FOREIGN PATENT DOCUMENTS

KR 1022060037754 A 5/2006

* cited by examiner

*Primary Examiner* — David Hung Vu
(74) *Attorney, Agent, or Firm* — Lowe, Hauptman, Ham & Berner, LLP

(57) ABSTRACT

There is provided an LED driving circuit. An LED driving circuit according to an aspect of the invention may include: a shift register separating dimming data and control data from serial peripheral interface (SPI) data and outputting the dimming data and the control data in predetermine data units; a scan register generating scan data according to the control data from the shift register; a first error detection unit detecting an error in the dimming data from the shift register; a second error detection unit detecting an error in the scan data from the scan register; and a logic operation unit performing an OR operation on an output signal from the first error detection unit and an output signal from the second error detection unit.

6 Claims, 3 Drawing Sheets

LED DRIVING CIRCUIT HAVING ERROR DETECTION FUNCTION

CROSS-REFERENCE TO RELATED APPLICATIONS

This application claims the priority of Korean Patent Application No. 10-2009-0121835 filed on Dec. 9, 2009, in the Korean Intellectual Property Office, the disclosure of which is incorporated herein by reference.

BACKGROUND OF THE INVENTION

1. Field of the Invention

The present invention relates to an LED driving circuit having an error detection function that is applicable to an LED TV set using an LED backlight unit, and more particularly, to an LED driving circuit having an error detection function that can detect errors caused by noise such as a surge or electrostatic discharge.

2. Description of the Related Art

In general, liquid crystal displays (LCDs) are light receiving elements that cannot emit light by themselves, and thus necessarily require backlight units (BLUs) in order to display a screen.

Cold cathode fluorescent lamps (CCFLs) and external electrode fluorescent lamps (EEFLs) have been used as the light sources of these backlight units (BLUs).

However, recently, a backlight unit has been manufactured using light emitting diodes (LEDs) that are environment friendly, have low power consumption, and have a high contrast ratio and excellent color reproducibility.

A method of driving this backlight unit causes motion blur due to an after image when one screen is converted into another screen, which leads to poor image quality.

In order to solve these problems, local dimming and scan dimming are being used. Here, according to scan dimming, backlight units (BLUs) are sequentially turned on according to image signals being input to the backlight units (BLUs) from top to bottom.

FIG. 1 is a block diagram illustrating an LED backlight unit (BLU) according to an exemplary embodiment of the invention. As shown in FIG. 1, an LED backlight unit includes an LED lamp array 10 having a plurality of LED lamps and an LED driving circuit 20 having a plurality of LED driving ICs driving the LED lamp array 10.

The LED driving circuit 20 performs local dimming and scan dimming by using a vertical synchronization signal Vsync and pixel values included in image data from an image processing block 30 (also known as an image processing board) to thereby generate driving signals as shown in FIG. 2.

FIG. 2 is a timing chart illustrating driving signals obtained through scan dimming of an LED backlight unit. In FIG. 2, for one period of the vertical synchronization signal Vsync, a plurality of driving signals DS0 to DS9 have high levels in a sequential manner. The LED driving ICs sequentially turn on the plurality of LEDs.

Meanwhile, in an existing backlight unit, an image processing block directly generates LED PWM signals in association with scan/local dimming and supplies the LED PWM signals to the LED driving ICs. However, this driving method requires the number of lines to be as many as the number of channels to be driven, which increases the manufacturing costs of a PCB board.

In order to solve these problems, recently, a driving method has been used in which LED driving ICs receive only the data necessary for dimming from an image processing block and directly generate signals in association with dimming.

These LED driving ICs will be described in brief. An LED driving IC generates a PWM signal for local dimming and an LED turn-on time control signal for scanning. In order to generate the PWM signal and the LED turn-on time control signal, the LED driving IC stores a control signal and a specific command therein and periodically generates a PWM signal according to the stored command.

That is, in order to generate a PWM signal and an LED turn-on time control signal in order to perform LED dimming (local and scan dimming), the LED driving IC receives the following three types of data from the image processing block and stores these data in an internal register:

local dimming data (0 to 255) to generate a PWM signal a scan dimming start point indicating a start point of scan dimming, and a scan dimming mask indicating a scan dimming turn-on interval.

The LED driving IC can turn on an LED driving PWM signal by using these three types of data.

However, when this LED driving IC is applied to a display device such as a television or a monitor, it is exposed to various noise such as electrostatic discharge (ES) and a surge, which lead to signal distortion and ultimately cause the LED driving IC to malfunction.

SUMMARY OF THE INVENTION

An aspect of the present invention provides an LED driving circuit having an error detection function that can detect errors caused by a surge or electrostatic discharge.

According to an aspect of the present invention, there is provided an LED driving circuit having an error detection function, the LED driving circuit including: a shift register separating dimming data and control data from serial peripheral interface (SPI) data and outputting the dimming data and the control data in predetermine data units; a scan register generating scan data according to the control data from the shift register; a first error detection unit detecting an error in the dimming data from the shift register; a second error detection unit detecting an error in the scan data from the scan register; and a logic operation unit performing an OR operation on an output signal from the first error detection unit and an output signal from the second error detection unit.

The first error detection unit may perform a cyclic redundancy check (CRC) using preset CRC data and the dimming data from the shift register and outputs an error signal when an error is detected.

The second error detection unit may perform a cyclic redundancy check (CRC) using preset CRC data and the scan data from the scan register and outputs an error signal when an error is detected.

According to another aspect of the present invention, there is provided an LED driving circuit having an error detection function, the LED driving circuit including: an SPI slave receiving and latching SPI data including dimming data and control data; a shift register separating the dimming data and the control data from the SPI data from the SPI slave and outputting the dimming data and the control data in predetermined data units; a scan register generating scan data according to the control data from the shift register; a PWM generation unit generating a PWM signal according to the scan data and the dimming data from the shift register; a first error detection unit detecting an error in the dimming data from the shift register; a second error detection unit detecting an error in the scan data from the scan register; and a logic operation unit performing an OR operation on an output signal from the first error detection unit and an output signal from the second error detection unit to thereby output a reset signal.

The first error detection unit may perform a cyclic redundancy check (CRC) using preset CRC data and the dimming data from the shift register and outputs an error signal when an error is detected.

The second error detection unit may perform a cyclic redundancy check (CRC) using preset CRC data and the scan data from the scan register and outputs an error signal when an error is detected.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Figure 1:
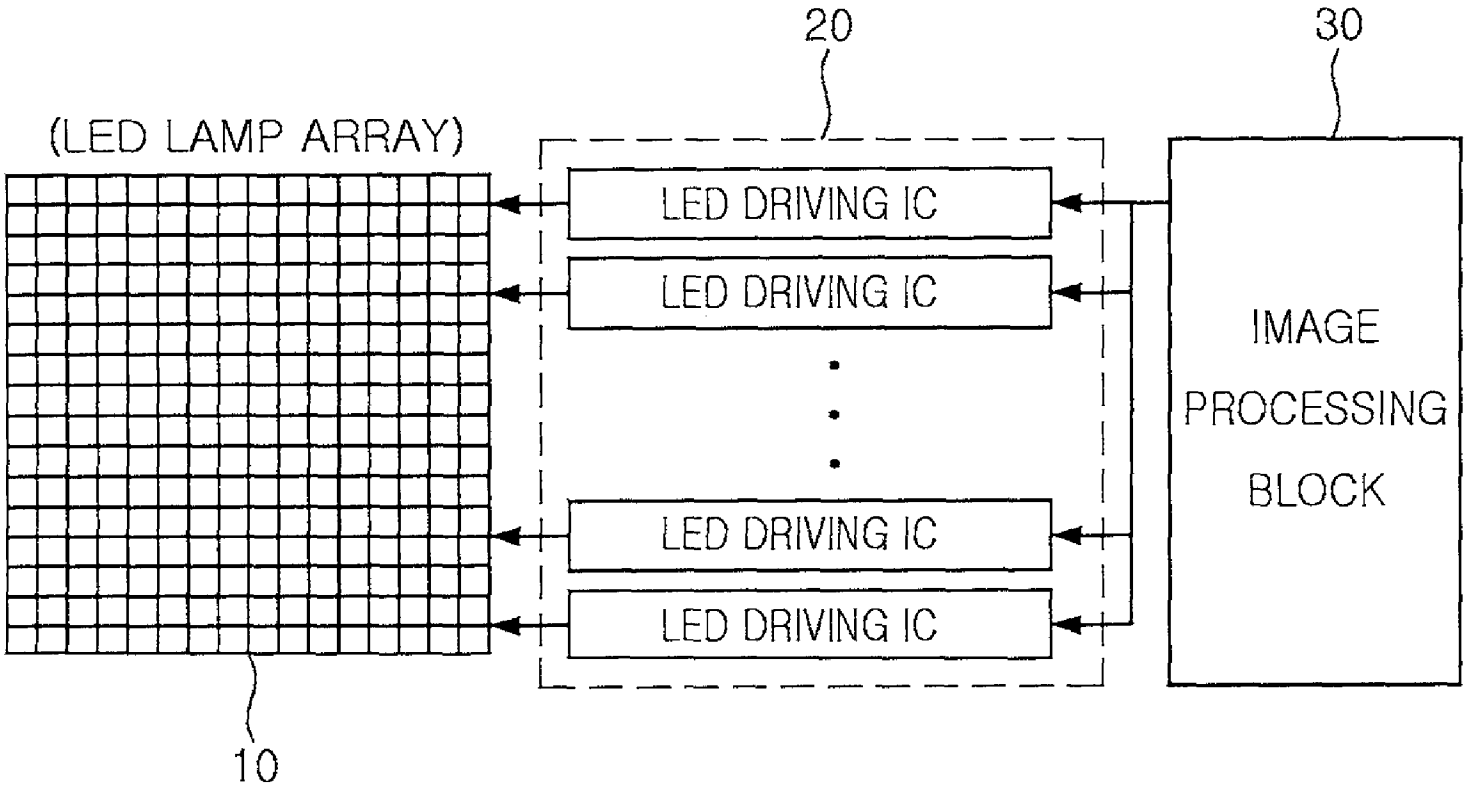
FIG. 1 is a block diagram illustrating an LED backlight unit (BLU) according to an exemplary embodiment of the present invention.
Figure 2:
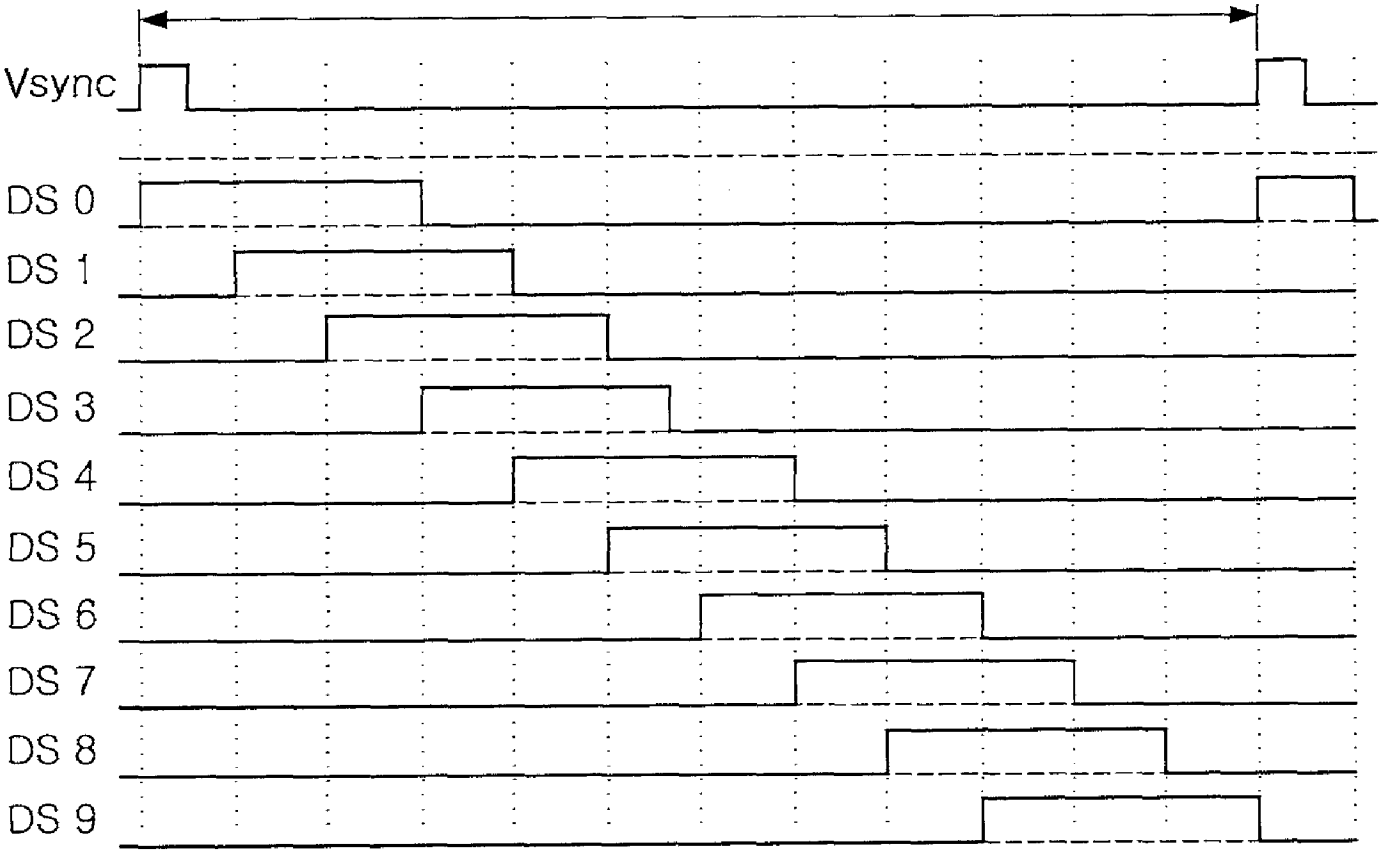
FIG. 2 is a timing chart illustrating driving signals by scan dimming of an LED backlight unit according to an exemplary embodiment of the present invention.

Exemplary embodiments of the present invention will now be described in detail with reference to the accompanying drawings.

The invention may, however, be embodied in many different forms and should not be construed as being limited to the embodiments set forth herein. Rather, these embodiments are provided so that this disclosure will be thorough and complete, and will fully convey the scope of the invention to those skilled in the art. In the drawings, the same reference numerals will be used throughout to designate the components having substantially the same configuration and function.

Figure 3:
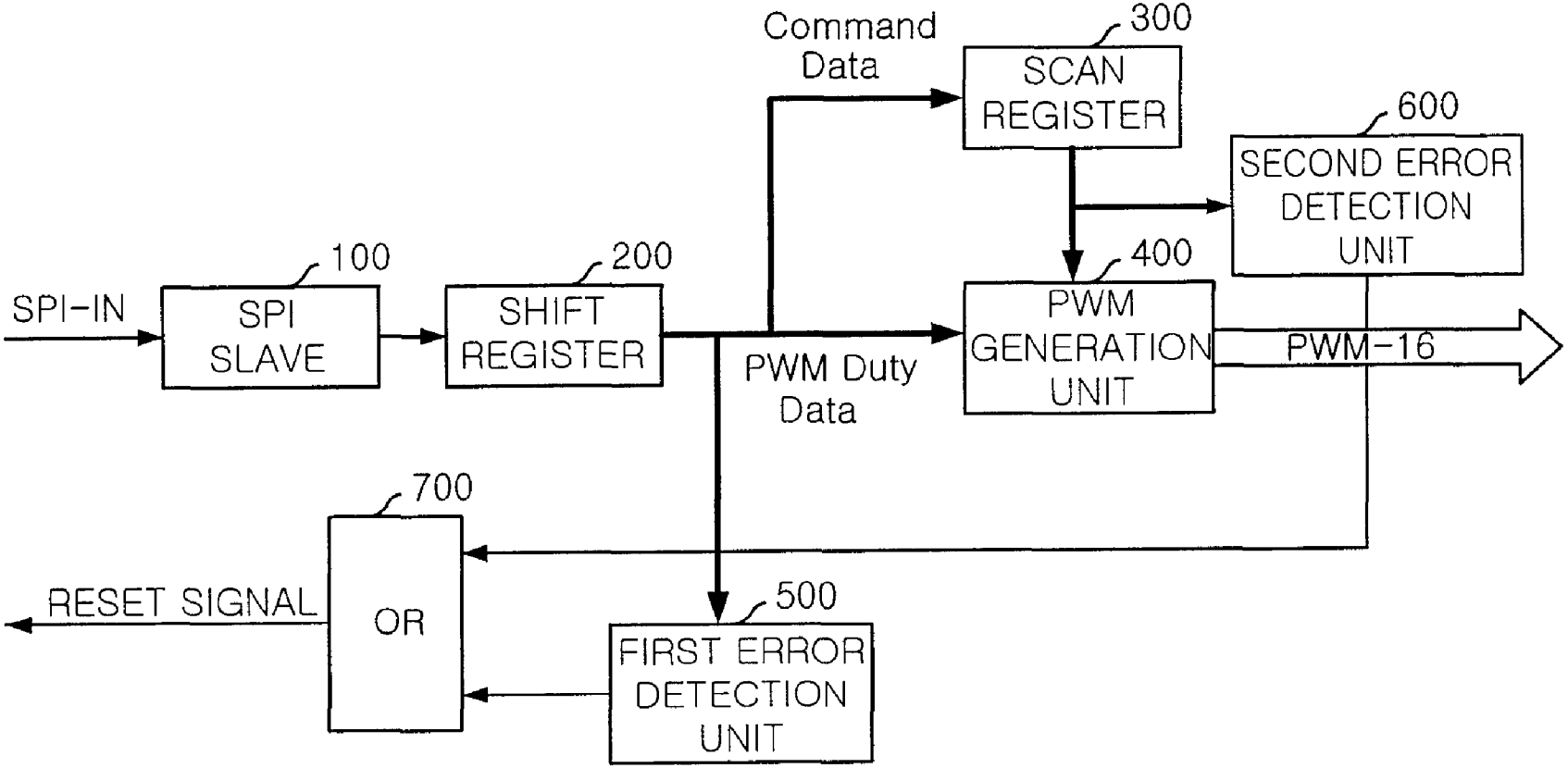
FIG. 3 is a block diagram illustrating an LED driving circuit according to an exemplary embodiment of the present invention.

FIG. 3 is a block diagram illustrating an LED driving circuit according to an exemplary embodiment of the invention. Referring to FIG. 3, an LED driving circuit according to this embodiment may include a shift register 200, a scan register 300, a first error detection unit 500, a second error detection unit 600, and a logic operation unit 700. The shift register 200 separates dimming data and control data from serial peripheral interface (SPI) data and outputs the dimming data and the control data in predetermined data units. The scan register 300 generates scan data according to the control data from the shift register 200. The first error detection unit 500 detects errors in the dimming data from the shift register 200. The second error detection unit 600 detects errors in the scan data from the scan register 300. The logic operation unit 700 performs an OR operation on an output signal from the first error detection unit 500 and an output signal from the second error detection unit 600 to thereby generate a reset signal.

Here, the dimming data contains brightness information necessary for generating a PWM signal, while the control data contains information about a turn-on interval of scan dimming and a start point of scan dimming.

Furthermore, the LED driving circuit according to this embodiment may further include an SPI slave 100 and a PWM generation unit 400. The SPI slave 100 receives and latches the SPI data, including the dimming data and the control data, to output the SPI data to the shift register 200. The PWM generation unit 400 generates a PWM signal according to the dimming data and the scan data from the shift register 200.

Here, the SPI data includes CRC codes as well as the dimming data and the control data. Here, the SPI data is separated into dimming data containing CRC codes and control data containing CRC codes in the shift register 200.

Here, the first error detection unit 500 performs a cyclic redundancy check (CRC) using preset CRC data and the dimming data from the shift register 200 and outputs an error signal when an error is detected.

The second error detection unit 600 performs a cyclic redundancy check (CRC) using preset CRC data and the scan data from the scan register 300 and outputs an error signal when an error is detected.

Hereinafter, the operation and effects of the invention will be described in detail with reference to the accompanying drawings.

The LED driving circuit according to this embodiment will be described with reference to FIG. 3. In FIG. 3, the SPI slave 100 of the LED driving circuit according to this embodiment receives and latches the SPI data, including the dimming data and the control data, from an SPI master to supply the SPI data to the shift register 200.

The shift register 200 separates the dimming data and the control data from the serial peripheral interface SPI (SPI) data, aligns the dimming data and the control data in predetermined data units, and outputs the dimming data to the PWM generation unit 400 and the first error detection unit 500 and the control data to the scan register 300 and the second error detection unit 600.

The scan register 300 generates scan data according to the control data from the shift register 200 and supplies the generated scan data to the PWM generation unit 400.

That is, the dimming data contains brightness information necessary to generate a PWM signal, and the control data contains information about a turn-on interval of scan dimming and a start point of scan dimming. Therefore, the scan register 300 can generate the scan data using the information about the turn-on interval of scan dimming and the start point of scan dimming.

The PWM generation unit 400 generates a PWM signal according to the dimming data and the scan data from the shift register 200. That is, the PWM generation unit 400 generates a PWM signal, necessary for driving LEDs, by using the dimming data containing the brightness information and the scan data based on the scan start point and the turn-on interval.

The first error detection unit 500 may detect errors in the dimming data from the shift register 200.

Furthermore, the second error detection unit 600 may detect errors in the scan data from the scan register 300.

The logic operation unit 700 performs an OR operation on an output signal from the first error detection unit 500 and an output signal from the second error detection unit 600 to thereby generate a reset signal.

Here, the SPI data contains CRC codes as well as the dimming data and the control data. Here, the SPI data is separated into dimming data containing CRC codes and control data containing CRC codes in the shift register 200.

Here, the first error detection unit 500 performs a cyclic redundancy check (CRC) using preset CRC data and the dimming data from the shift register 200 and outputs an error signal when an error is detected.

For example, the first error detection unit 500 compares the CRC codes, contained in the dimming data, with predetermined CRC codes and determines that there is no error when both of the CRC codes coincide with each other, or determines that there is an error when they do not coincide with each other and outputs an error signal "1" to indicate the error.

Furthermore, the second error detection unit 600 performs a cyclic redundancy check (CRC) using preset CRC data and the scan data from the scan register 300 and outputs an error signal when an error is detected.

For example, the second error detection unit 600 compares the CRC code, contained in the control data, with predetermined CRC codes and determines that there is no error when both of the CRC codes coincide with each other, or determines that there is an error when they do not coincide with each other and outputs an error signal "1" to indicate the error.

Therefore, the logic operation unit 700 performs an OR operation on the error signal "1" from the first error detection unit 500 and the error signal "1" from the second error detection unit 600 to generate a reset signal.

For example, when the logic operation unit 700 is composed of an OR gate, the logic operation unit 700 may generate a reset signal when the error signal "1" is output from at least one of the first error detection unit 500 and the second error detection unit 600.

As described above, the operation of the LED driving circuit can be stopped by using the reset signal that is output from the logic operation unit 700.

Therefore, in the LED driving circuit according to this embodiment, it is possible to detect an error when there is an error in at least one of the dimming data and the control data.

As set forth above, according to exemplary embodiments of the invention, an error, caused by noise such as electrostatic discharge or a surge, can be detected, and LED driving can be stopped by error detection.

While the present invention has been shown and described in connection with the exemplary embodiments, it will be apparent to those skilled in the art that modifications and variations can be made without departing from the spirit and scope of the invention as defined by the appended claims.

What is claimed is:

1. An LED driving circuit having an error detection function, the LED driving circuit comprising:

a shift register separating dimming data and control data from serial peripheral interface (SPI) data and outputting the dimming data and the control data in predetermine data units;

a scan register generating scan data according to the control data from the shift register;

a first error detection unit detecting an error in the dimming data from the shift register;

a second error detection unit detecting an error in the scan data from the scan register; and a logic operation unit performing an OR operation on an output signal from the first error detection unit and an output signal from the second error detection unit.

2. The LED driving circuit of claim 1, wherein the first error detection unit performs a cyclic redundancy check (CRC) using preset CRC data and the dimming data from the shift register and outputs an error signal when an error is detected.

3. The LED driving circuit of claim 2, wherein the second error detection unit performs a cyclic redundancy check (CRC) using preset CRC data and the scan data from the scan register and outputs an error signal when an error is detected.

4. An LED driving circuit having an error detection function, the LED driving circuit comprising:

an SPI slave receiving and latching SPI data including dimming data and control data;

a shift register separating the dimming data and the control data from the SPI data from the SPI slave and outputting the dimming data and the control data in predetermined data units;

a scan register generating scan data according to the control data from the shift register;

a PWM generation unit generating a PWM signal according to the scan data and the dimming data from the shift register;

a first error detection unit detecting an error in the dimming data from the shift register;

a second error detection unit detecting an error in the scan data from the scan register; and a logic operation unit performing an OR operation on an output signal from the first error detection unit and an output signal from the second error detection unit to thereby output a reset signal.

5. The LED driving circuit of claim 4, wherein the first error detection unit performs a cyclic redundancy check (CRC) using preset CRC data and the dimming data from the shift register and outputs an error signal when an error is detected.

6. The LED driving circuit of claim 5, wherein the second error detection unit performs a cyclic redundancy check (CRC) using preset CRC data and the scan data from the scan register and outputs an error signal when an error is detected.

* * * * *